US009594325B2

(12) United States Patent
Kurano

(10) Patent No.: US 9,594,325 B2
(45) Date of Patent: Mar. 14, 2017

(54) IMAGE FORMATION METHOD

(71) Applicant: KYOCERA Document Solutions Inc., Osaka (JP)

(72) Inventor: Yusuke Kurano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/829,339

(22) Filed: Aug. 18, 2015

(65) Prior Publication Data

US 2016/0054672 A1 Feb. 25, 2016

(30) Foreign Application Priority Data

Aug. 22, 2014 (JP) ..... 2014-168997

(51) Int. Cl.

| | |
|---|---|
| ***G03G 13/16*** | (2006.01) |
| ***G03G 13/01*** | (2006.01) |
| ***G03G 9/10*** | (2006.01) |
| ***G03G 9/113*** | (2006.01) |
| ***G03G 15/16*** | (2006.01) |
| *G03G 9/093* | (2006.01) |

(52) U.S. Cl.

CPC ..... *G03G 9/1132* (2013.01); *G03G 9/10* (2013.01); *G03G 13/013* (2013.01); *G03G 13/16* (2013.01); *G03G 15/1605* (2013.01); *G03G 2215/0132* (2013.01); *G03G 2215/0607* (2013.01)

(58) Field of Classification Search

CPC ..... G03G 9/09328; G03G 9/09364; G03G 9/09371; G03G 9/0823; G03G 13/16; G03G 13/013; G03G 15/1605

USPC ..... 430/45.51, 110.2

See application file for complete search history.

(56) References Cited

U.S. PATENT DOCUMENTS 4,642,281 A * 2/1987 Kakimi ..... G03G 9/09378 430/108.4
5,529,876 A * 6/1996 Sasaki ..... G03G 9/09328 264/4.33
8,213,833 B2 7/2012 Yagi et al.
8,216,759 B2 * 7/2012 Mitamura ..... G03G 9/1136 430/111.32
8,431,312 B2 * 4/2013 Masuda ..... G03G 9/107 430/111.1
8,486,600 B2 * 7/2013 Fukushima ..... G03G 9/107 430/111.32
9,329,509 B2 * 5/2016 Ozawa ..... G03G 9/09392
2004/0265714 A1 * 12/2004 Miyakawa ..... G03G 15/0131 430/45.3
2005/0008956 A1 * 1/2005 Sato ..... G03G 15/0126 430/45.51
2005/0271964 A1 12/2005 Etou et al.
2006/0275680 A1 * 12/2006 Miyakawa ..... G03G 9/09 430/45.51
2007/0015078 A1 * 1/2007 Suzuki ..... G03G 9/1139 430/111.1
2008/0171274 A1 7/2008 Yagi et al.
2009/0016745 A1 * 1/2009 Kolb ..... G03G 15/0848 399/27
2009/0092920 A1 * 4/2009 Nagayama ..... G03G 9/107 430/111.32
2010/0209147 A1 * 8/2010 Kubo ..... G03G 9/10 399/270
2012/0057898 A1 * 3/2012 Sakata ..... G03G 9/1131 399/111
2014/0087301 A1 * 3/2014 Tujihiro ..... G03G 9/1135 430/111.35
2015/0004537 A1 * 1/2015 Ozawa ..... G03G 9/09328 430/108.21
2015/0004540 A1 * 1/2015 Ozawa ..... G03G 9/0825 430/109.3
2015/0017582 A1 * 1/2015 Ozawa ..... G03G 9/0825 430/108.22
2015/0024320 A1 * 1/2015 Tanaka ..... G03G 9/09321 430/108.22
2015/0030978 A1 * 1/2015 Ozawa ..... G03G 9/09307 430/110.2
2015/0030979 A1 * 1/2015 Miyamoto ..... G03G 9/09307 430/137.13
2015/0037724 A1 * 2/2015 Mizobe ..... G03G 9/09357 430/108.22
2015/0118612 A1 * 4/2015 Maetani ..... G03G 9/09328 430/109.1

(Continued)

FOREIGN PATENT DOCUMENTS

JP 04081767 A * 3/1992
JP H11-305566 A 11/1999
JP 2004-138985 A 5/2004
JP 2004-294467 A 10/2004
JP 2004-294468 A 10/2004

(Continued)

OTHER PUBLICATIONS

English language translation of JP 04-081767 (Mar. 1992).*

(Continued)

*Primary Examiner* — Christopher Rodee

(74) *Attorney, Agent, or Firm* — Studebaker & Brackett PC

(57) ABSTRACT

A two-component developer includes a toner and a carrier. The toner includes a plurality of toner particles. The carrier includes a plurality of carrier particles. Each of the toner particles includes a toner core and a shell layer disposed over the surface of the toner core. The toner has a charge decay constant of at least 0.020 and no greater than 0.050 as measured with the toner particles in an external additive-free state. The carrier has a volume resistivity of at least $1.0\times10^{12}$ Ω·cm.

4 Claims, 1 Drawing Sheet

(56) References Cited

U.S. PATENT DOCUMENTS

| | | | | |
|---|---|---|---|---|
| 2015/0140488 | A1* | 5/2015 | Terasaki | G03G 9/09392 430/109.1 |
| 2015/0153662 | A1* | 6/2015 | Maetani | G03G 9/08 430/108.22 |
| 2015/0185649 | A1* | 7/2015 | Miyamoto | G03G 9/09328 430/110.2 |
| 2015/0185657 | A1* | 7/2015 | Matsui | G03G 9/0833 430/105 |
| 2015/0205220 | A1* | 7/2015 | Ozawa | G03G 9/09314 430/108.22 |
| 2015/0212440 | A1* | 7/2015 | Ozawa | G03G 9/09314 430/108.22 |
| 2015/0212445 | A1* | 7/2015 | Terasaki | G03G 9/09328 430/110.2 |

FOREIGN PATENT DOCUMENTS

| | | | |
|---|---|---|---|
| JP | 2004-294469 | A | 10/2004 |
| JP | 2008-033178 | A | 2/2008 |
| JP | 2008-170836 | | 7/2008 |
| JP | 2014-048341 | A | 3/2014 |

OTHER PUBLICATIONS

An Office Action; "Notification of Reasons for Refusal" issued by the Japanese Patent Office on Jun. 21, 2016, which corresponds to Japanese Patent Application No. 2014-168997 and is related to U.S. Appl. No. 14/829,339; with English language translation.

* cited by examiner

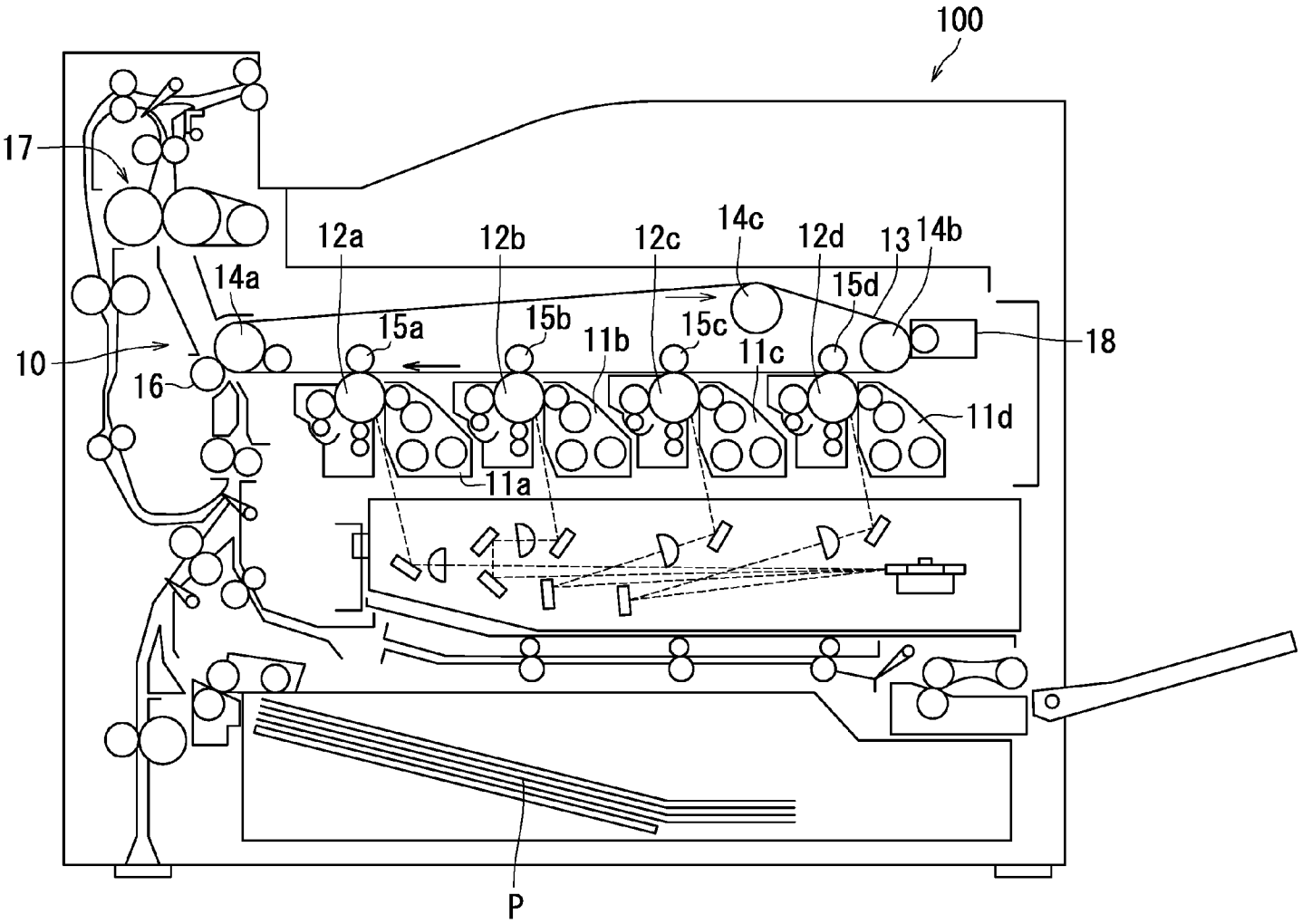
100
18
14b
13
15d
12d
14c
11c
15c
12c
11b
15b
12b
11a
15a
12a
14a
16
17
10
11d
P

IMAGE FORMATION METHOD

INCORPORATION BY REFERENCE

The present application claims priority under 35 U.S.C. §119 to Japanese Patent Application No. 2014-168997, filed on Aug. 22, 2014. The contents of this application are incorporated herein by reference in their entirety.

BACKGROUND

The present disclosure relates to two-component developers, image forming apparatuses, and image formation methods.

In one example, an image forming apparatus forms an image on a transfer sheet through a development process, a primary transfer process, and a secondary transfer process. In the development process, electrostatic latent images formed on four photosensitive drums are each developed using a two-component developer to form a toner image on each of the photosensitive drums. In the primary transfer process, the toner images formed on the photosensitive drums are transferred onto an intermediate transfer belt, in order, such that the toner images are superposed on one another on the intermediate transfer belt. In the secondary transfer process, the toner images on the intermediate transfer belt, which are superposed on one another, are collectively transferred onto a transfer sheet.

Image forming apparatuses that include a pre-transfer charger in proximity to an intermediate transfer belt in order to control toner charge are commonly known.

SUMMARY

A two-component developer according to the present disclosure includes a toner and a carrier. The toner includes a plurality of toner particles. The carrier includes a plurality of carrier particles. Each of the toner particles includes a toner core and a shell layer disposed over a surface of the toner core. The toner has a charge decay constant of at least 0.020 and no greater than 0.050 as measured with the toner particles in an external additive-free state. The carrier has a volume resistivity of at least $1.0\times10^{12}$ Ω·cm.

An image forming apparatus according to the present disclosure includes a plurality of electrostatic latent image bearing members, a developing device, and a transfer device. The transfer device includes an intermediate transfer member, a primary transfer section, and a secondary transfer section. The developing device develops electrostatic latent images, formed in one-to-one correspondence on the electrostatic latent image bearing members, to form toner images on the electrostatic latent image bearing members. The developing device develops each of the electrostatic latent images using a two-component developer according to the present disclosure. The primary transfer section transfers the toner images formed on the electrostatic latent image bearing members to the intermediate transfer member, in order, such that the toner images are superposed on one another on the intermediate transfer member. The secondary transfer section collectively transfers the toner images to a transfer target from the intermediate transfer member.

An image formation method according to the present disclosure includes electrostatic latent image development, primary transfer, and secondary transfer. In the electrostatic latent image development, electrostatic latent images, formed in one-to-one correspondence on a plurality of electrostatic latent image bearing members, are developed to form toner images on the electrostatic latent image bearing members. The electrostatic latent images are each developed using a two-component developer according to the present disclosure. In the primary transfer, the toner images formed on the electrostatic latent image bearing members are transferred to an intermediate transfer member such that the toner images are superposed on one another on the intermediate transfer member. In the secondary transfer, the toner images are transferred to a transfer target from the intermediate transfer member.

BRIEF DESCRIPTION OF THE DRAWINGS

The FIGURE illustrates a configuration of an image forming apparatus according to an embodiment of the present disclosure.

DETAILED DESCRIPTION

The following explains an embodiment of the present disclosure. It should be noted that when evaluation results (for example, values indicating shapes or properties) pertaining to powders (specifically, toner cores, toner mother particles, external additives, toners, and carriers) are given, such evaluation results are number averages of values measured with respect to an appropriate number of particles unless otherwise stated. Also, unless otherwise stated, the number average particle diameter of a powder is the diameter of a representative circle of a particle (i.e., the diameter of a circle having the same surface area as a projection of the particle) measured using a microscope. In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl.

A two-component developer according to the present embodiment includes a toner and a carrier. The toner and the carrier are each a powder composed of a plurality of particles. The toner includes a plurality of toner particles. The carrier includes a plurality of carrier particles.

Each of the toner particles in the toner includes a toner core and a shell layer (capsule layer) disposed over the surface of the toner core. An external additive may adhere to the surface of the toner core or the surface of the shell layer. Also, more than one shell layer may be layered on the surface of the toner core. The toner included in the two-component developer according to the present embodiment can for example be used as a positively chargeable toner. In a situation in which an external additive is not necessary, the external additive may be omitted. In the present description, the term "toner mother particles" is used to refer to toner particles prior to adhesion of an external additive.

The two-component developer according to the present embodiment can for example be used in an image forming apparatus to develop an electrostatic latent image. The following explains an example of a tandem electrophotographic apparatus (image forming apparatus 100) with reference to the figure.

The image forming apparatus 100 includes developing devices 11*a*-11*d*, photosensitive drums 12*a*-12*d*, a transfer device 10, a fixing device 17, and a cleaning roller 18. The transfer device 10 includes a transfer belt 13, a drive roller

14*a*, a driven roller 14*b*, a tension roller 14*c*, primary transfer rollers 15*a*-15*d*, and a secondary transfer roller 16. The transfer belt 13 is wound around the drive roller 14*a*, the driven roller 14*b*, and the tension roller 14*c*. The drive roller 14*a* causes the transfer belt 13 to circulate in a direction indicated by arrows in the figure. The cleaning roller 18 removes residual toner from the transfer belt 13. In order for the image forming apparatus 100 to form an image, each of the developing devices 11*a*-11*d* is loaded with a developer that includes a toner and a carrier.

In the image forming apparatus 100, the developing devices 11*a*, 11*b*, 11*c*, and 11*d* use the developer to develop respective electrostatic latent images formed on the photosensitive drums 12*a*, 12*b*, 12*c*, and 12*d* (electrostatic latent image bearing members). Through development, charged toner is caused to adhere to the electrostatic latent images. Next, the toner (toner image) adhering to each of the photosensitive drums 12*a*-12*d* is transferred (primary transfer) to the transfer belt 13 (intermediate transfer member) through application of a bias (voltage) to a corresponding one of the primary transfer rollers 15*a*-15*d*. The toner images on the transfer belt 13 are subsequently transferred (secondary transfer) to a conveyed recording medium P (transfer target) through application of a bias (voltage) to the secondary transfer roller 16. Next, the fixing device 17 heats toner on the recording medium P in order to fix the toner to the recording medium P. The above process results in formation of an image on the recording medium P. It should be noted that the primary transfer rollers 15*a*-15*d* and components (specifically, a power supply, a control circuit, etc.) for applying voltage to each of the primary transfer rollers 15*a*-15*d* are equivalent to a primary transfer section. Likewise, the secondary transfer roller 16 and components (specifically, a power supply, a control circuit, etc.) for applying voltage to the secondary transfer roller 16 are equivalent to a secondary transfer section.

The image forming apparatus 100 includes a plurality of photosensitive drums 12*a*-12*d*. Therefore, the image forming apparatus 100 can superpose a plurality of toner images (for example, toner images of different colors) on the transfer belt 13 during primary transfer by transferring toner images formed on the photosensitive drums 12*a*-12*d* onto the transfer belt 13, in order. The image forming apparatus 100 can also collectively transfer the superposed toner images to a recording medium P from the transfer belt 13 during secondary transfer. A full-color image can for example be formed by superposing toner images of four different colors: black, yellow, magenta, and cyan. The recording medium P can for example be printing paper.

The image forming apparatus 100 includes devices for imparting electrical charge on toner in order to respectively perform primary transfer and secondary transfer of the toner. Each of the aforementioned devices is substantially formed by one or more transfer rollers (primary transfer rollers 15*a*, 15*b*, 15*c*, and 15*d*, or secondary transfer roller 16) and a power supply (not illustrated) that applies a bias to the one or more transfer rollers.

A two-component developer according to the present embodiment includes a toner having features (1) and (2) explained below and a carrier having feature (3) explained below. Among all toner included in the two-component developer according to the present embodiment, preferably at least 80% by mass of the toner has features (1) and (2), more preferably at least 90% by mass of the toner has features (1) and (2), and particularly preferably 100% by mass of the toner has features (1) and (2). Among all carrier included in the two-component developer according to the present embodiment, preferably at least 80% by mass of the carrier has feature (3), more preferably at least 90% by mass of the carrier has feature (3), and particularly preferably 100% by mass of the carrier has feature (3).

(1) Each toner particle includes a toner core and a shell layer disposed over the surface of the toner core.

(2) The toner has a charge decay constant of at least 0.020 and no greater than 0.050 as measured in a state in which the toner particles have no attached external additive (referred to below as an external additive-free state). The charge decay constant ($\alpha$) of the toner in the external additive-free state is measured using an electrostatic dissipation measuring device (NS-D100 produced by Nano Seeds Corporation) based on an equation $V=V_0\exp(-\alpha\sqrt{t})$, or using any suitable alternative method. In the above equation, V represents surface potential, $V_0$ represents initial surface potential, and t represents decay time. The charge decay constant of the toner in the external additive-free state may be measured with respect to toner particles (strictly speaking, toner mother particles) prior to adhesion of external additive or with respect to toner particles after removal of external additive. It is thought that there is no significant difference between values measured according to the different methods described above.

(3) The carrier has a volume resistivity of at least $1.0\times10^{12}$ Ω·cm.

In the image forming apparatus and the image formation method according to the present embodiment, an image is formed on a transfer target through electrostatic latent image development, primary transfer, and secondary transfer. More specifically, in electrostatic latent image development, electrostatic latent images formed in one-to-one correspondence on a plurality of electrostatic latent image bearing members are developed to form toner images on the electrostatic latent bearing members. Each of the electrostatic latent images is developed using a two-component developer according to the present embodiment. In primary transfer, the toner images formed on the electrostatic latent image bearing members are transferred to an intermediate transfer member, in order, such that the toner images are superposed on one another on the intermediate transfer member. In secondary transfer, the superposed toner images on the intermediate transfer member are collectively transferred to a transfer target. The image forming apparatus according to the present embodiment may include a control section (for example, a CPU, a memory, and programs) that controls operation of the image forming apparatus, based on the output of various sensors, to perform the processes described above (electrostatic latent image development, primary transfer, and secondary transfer). The image forming apparatus according to the present embodiment may further include an input section (for example, a keyboard, a mouse, or a touch panel) and a communication device.

Feature (1) of the two-component developer is advantageous for improving high-temperature preservability of the toner. More specifically, the shell layers that coat the toner cores are thought to improve the high-temperature preservability of the toner. In order to improve high-temperature preservability of the toner, the shell layers preferably contain a thermosetting resin and more preferably are substantially composed of the thermosetting resin.

Features (2) and (3) of the two-component developer are advantageous for inhibiting secondary transfer defects and fixing defects.

More specifically, in a situation in which the charge decay constant of the toner in the external additive-free state is at least 0.020, there is a smaller tendency for non-uniform charge (non-uniformity within a toner image) of toner on the intermediate transfer member to occur as a consequence of primary transfer being performed a plurality of times (i.e., primary transfer being performed for each electrostatic latent image bearing member). Also, in a situation in which the charge decay constant of the toner in the external additive-free state is at least 0.020, it is easier to inhibit charge of the toner from rising excessively and, as a consequence, it is easier to inhibit secondary transfer defects and fixing defects (for example, electrostatic scattering or electrostatic offset) caused by excessive toner charge.

In a situation in which the charge decay constant of the toner in the external additive-free state is no greater than 0.050, it is easier to ensure that toner on the intermediate transfer member has sufficient charge for secondary transfer and, as a consequence, it is easier to inhibit secondary transfer defects caused by insufficient toner charge.

In a situation in which the volume resistivity of the carrier is at least $1.0\times10^{12}$ Ω·cm, it is easier to inhibit excessive toner charging due to primary transfer and, as a consequence, it is easier to inhibit secondary transfer defects and fixing defects (for example, electrostatic scattering or electrostatic offset) caused by excessive toner charging. In order to prevent image density defects from occurring due to reduced developer developing ability, the carrier preferably has a volume resistivity of no greater than $1.0\times10^{15}$ Ω·cm. The volume resistivity of the carrier is for example measured using an Ultra High Resistance Meter produced by Advantest Corporation with an applied voltage of 1,000 V, or using any suitable alternative method.

In the image forming apparatus and the image formation method according to the present embodiment, an electrostatic latent image is developed using the two-component developer according to the present embodiment. As a consequence, it is thought that an image can be formed with high image quality while also preventing excessive toner charging when a plurality of toner images are transferred onto an intermediate transfer member such as to be superposed on one another.

The image forming apparatus and the image formation method according to the present embodiment preferably have feature (4) explained below.

(4) In development of electrostatic latent images formed in one-to-one correspondence on a plurality of electrostatic latent image bearing members, a plurality of different types of the two-component developer, differing from one another in terms of toner charge decay constant, are used. Also, primary transfer of the toner images is performed in descending order of toner charge decay constant.

In primary transfer, a toner can easily be excessively charged due to electrical charge being imparted on the toner through application of a bias (voltage) to primary transfer rollers. For example, in the image forming apparatus 100 illustrated in the figure, among toners included in two-component developers in the developing devices 11*a*-11*d*, it is thought that excessive charging occurs most easily for the toner included in the two-component developer in the developing device 11*d*, which is a furthest upstream of the developing devices 11*a*-11*d* in terms of primary transfer (i.e., at an earliest position for primary transfer). The reason for the above is that the toner included in the two-component developer in the developing device 11*d* is subjected to bias application four times by the primary transfer rollers 15*a*-15*d*.

In the image forming apparatus and the image formation method having feature (4), developers are loaded into developing devices such that primary transfer is performed in descending order of toner charge decay constant. The greater the charge decay constant of a toner, the easier it is for electrical charge to dissipate from the toner. In each of the image forming apparatus and the image formation method having feature (4), the easier it is for a toner to be excessively charged (i.e., the further upstream the toner is positioned in terms of primary transfer), the greater the charge decay constant of the toner. It is thought that as a consequence, non-uniformity of toner charge in a situation in which a plurality of colors are used (for example, four colors) can be reduced. For example, in the image forming apparatus 100 illustrated in the figure, a toner included in a two-component developer in the developing device 11*a* preferably has a smallest charge decay constant. In addition, toners included in two-component developers in the developing devices 11*a*-11*d* preferably have charge decay constants in ascending order from the developing device 11*a* to the developing device 11*d* (i.e., in terms of toner charge decay constant, developing device 11*a*<developing device 11*b*<developing device 11*c*<developing device 11*d*).

As explained above, through the two-component developer, the image forming apparatus, and the image formation method according to the present embodiment, it is possible to inhibit secondary transfer defects and fixing defects (for example, electrostatic scattering or electrostatic offset) caused by excessive toner charging without providing a pre-transfer charger. By omitting the pre-transfer charger, configuration of the image forming apparatus can be simplified and costs can be reduced.

In the toner included in the two-component developer according to the present embodiment, the toner cores are preferably anionic and a material used for forming the shell layers (referred to below as a shell material) is preferably cationic. In a toner having a configuration such as described above, the cationic shell material is attracted toward the surface of the toner cores during shell layer formation. In a more specific example, in an aqueous medium in which the shell material is positively charged and the toner cores are negatively charged, it is thought that the shell material is electrically attracted toward the toner cores and shell layers are formed on the surface of the toner cores through, for example, in-situ polymerization. As a result of the shell material being attracted toward the toner cores, it is thought that the shell layers can be easily formed on the surface of the toner cores in a uniform manner without using a dispersant, or using only a small amount of dispersant. Also, as a result of particles having the same polarity repelling one another, aggregation of particles in the liquid can be inhibited.

Zeta potential can be used as an indicator of the magnitude of anionic or cationic strength. For example, particles (for example, toner cores or toner particles) are anionic if the particles (for example, toner cores or toner particles) have a negative zeta potential (i.e., less than 0 V) when measured at 25° C. in an aqueous medium adjusted to pH 4. It should be noted that in the present embodiment, pH 4 is equivalent to the pH of a toner core dispersion (aqueous medium) during shell layer formation (i.e., during polymerization). Examples of preferable methods for measuring the zeta potential include an electrophoresis method, an ultrasound method, and an electric sonic amplitude (ESA) method.

Triboelectric charge with a standard carrier may alternatively be used as an indicator of the magnitude of anionic or cationic strength. In order that the shell material is attracted toward the toner cores during shell layer formation, the toner cores preferably have a triboelectric charge of no greater than −10 μC/g when the toner cores are mixed with the standard carrier.

The following explains, in order, the toner cores (binder resin and internal additives), the shell layers, and external additives. Non-essential components (for example, a colorant, a releasing agent, a charge control agent, and a magnetic powder) may be omitted depending on the intended use of the toner. Note that the term "(meth)acryl" is used as a generic term for both acryl and methacryl.

[Toner Cores]

The toner cores contain a binder resin. The toner cores may optionally contain one or more internal additives (for example, a colorant, a releasing agent, a charge control agent, and a magnetic powder).

(Toner Core Binder Resin)

The binder resin is typically a main component (for example, at least 85% by mass) in the toner cores. Therefore, properties of the binder resin are thought to have a large influence on overall properties of the toner cores. For example, in a situation in which the binder resin has an ester group, a hydroxyl group, an ether group, an acid group, or a methyl group, the toner cores have a stronger tendency to be anionic. On the other hand, in a situation in which the binder resin has an amino group or an amide group, the toner cores have a stronger tendency to be cationic. In order that the binder resin is strongly anionic, the binder resin preferably has a hydroxyl value (measured according to JIS (Japanese Industrial Standard) K0070-1992) and an acid value (measured according to JIS K0070-1992) that are each at least 10 mg KOH/g, and more preferably at least 20 mg KOH/g.

The binder resin preferably has at least one chemical group selected from the group consisting of an ester group, a hydroxyl group, an ether group, an acid group, and a methyl group, and more preferably has either or both of a hydroxyl group and a carboxyl group. A binder resin having a functional group such as described above readily reacts with the shell material (for example, methylol melamine) to form chemical bonds. Formation of chemical bonds between the binder resin and the shell material ensures strong bonding between the toner cores and the shell layers. Also, the binder resin preferably has a functional group including activated hydrogen in molecules thereof.

The binder resin preferably has a glass transition point (Tg) that is no greater than a curing initiation temperature of the shell material. It is thought that as a result of using a binder resin having a glass transition point (Tg) such as described above, toner fixability has a low tendency to deteriorate, even during high speed fixing. The glass transition point (Tg) of the binder resin can for example be measured using a differential scanning calorimeter. More specifically, the glass transition point (Tg) can be obtained from a point of change of specific heat on a heat absorption curve that is plotted by measuring a sample (i.e., the binder resin) using the differential scanning calorimeter (DSC-6220 produced by Seiko Instruments Inc.).

The binder resin preferably has a softening point (Tm) of no greater than 100° C. and more preferably no greater than 95° C. As a result of the softening point (Tm) of the binder resin being no greater than 100° C. (more preferably no greater than 95° C.), toner fixability has a low tendency to deteriorate, even during high speed fixing. Furthermore, in a situation in which the softening point (Tm) of the binder resin is no greater than 100° C. (more preferably no greater than 95° C.), partial softening of the toner cores tends to occur during a curing reaction of the shell layers when the shell layers are formed on the surface of the toner cores in an aqueous medium and, as a result, the toner cores tend to become round in shape due to surface tension. The softening point (Tm) of the binder resin can be adjusted by using a combination of resins having different softening points (Tm) as the binder resin.

The softening point (Tm) of the binder resin can for example be measured using a capillary rheometer. More specifically, a sample (i.e., the binder resin) is loaded in the capillary rheometer (CFT-500D produced by Shimadzu Corporation) and melt flow of the binder resin is caused under specific conditions. Through the above, an S-shaped curve (horizontal axis: temperature, vertical axis: stroke) is plotted for the binder resin. The softening point (Tm) of the binder resin can be read from the plotted S-shaped curve. The softening point (Tm) of the measurement sample (i.e., the binder resin) is a temperature on the plotted S-shaped curve corresponding to a stroke value of $(S_1+S_2)/2$, where $S_1$ represents a maximum stroke value and $S_2$ represents a base line stroke value at low temperatures.

The binder resin preferably has a solubility parameter (SP value) of at least 10 and no greater than 30, and more preferably at least 15 and no greater than 25. In a situation in which the SP value of the binder resin is at least 10 and no greater than 30, the binder resin has improved wettability in an aqueous medium due to the SP value of the binder resin being similar to the SP value of water (23). As a consequence, uniform dispersion of the toner cores in an aqueous medium can be readily achieved without using a dispersant. The SP value is calculated according to the Fedors calculation method.

The binder resin is preferably a thermoplastic resin. Examples of preferable thermoplastic resins that can be used as the binder resin include styrene-based resins, acrylic acid-based resins, olefin-based resins (specific examples includes polyethylene resins and polypropylene resins), vinyl resins (specific examples include vinyl chloride resins, polyvinyl alcohol, vinyl ether resins, and N-vinyl resins), polyester resins, polyamide resins, urethane resins, styrene-acrylic acid-based resins, and styrene-butadiene-based resins. Among the resins listed above, styrene-acrylic acid-based resins and polyester resins are preferable in terms of improving colorant dispersibility in the toner cores, toner chargeability, and toner fixability with respect to a recording medium.

The following explains a styrene-acrylic acid-based resin that can be used as the binder resin. The styrene-acrylic acid-based resin is a copolymer of at least one type of styrene-based monomer and at least one type of acrylic acid-based monomer.

Preferable examples of styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of acrylic acid-based monomers include esters of (meth)acrylic acid, alkyl esters of (meth) acrylic acid, and hydroxyalkyl esters of (meth)acrylic acid. Specific examples of preferable alkyl esters of (meth)acrylic acid include methyl(meth)acrylate, ethyl(meth)acrylate, n-propyl(meth)acrylate, iso-propyl(meth)acrylate, n-butyl (meth)acrylate, iso-butyl(meth)acrylate, and 2-ethylhexyl (meth)acrylate. Specific examples of preferable hydroxyalkyl esters of (meth)acrylic acid include 2-hydroxyethyl (meth)acrylate, 3-hydroxypropyl(meth)acrylate, 2-hydroxypropyl(meth)acrylate, and 4-hydroxybutyl(meth) acrylate.

A hydroxyl group can be introduced into the styrene-acrylic acid-based resin by using a monomer having a hydroxyl group (specific examples include p-hydroxystyrene, m-hydroxystyrene, and hydroxyalkyl esters of (meth) acrylic acid) in preparation of the styrene-acrylic acid-based resin. The hydroxyl value of the prepared styrene-acrylic acid-based resin can be adjusted by adjusting the amount of the monomer having the hydroxyl group that is used in preparation of the styrene-acrylic acid-based resin.

A carboxyl group can be introduced into the styrene-acrylic acid-based resin by using an acrylic acid-based monomer in preparation of the styrene-acrylic acid-based resin. The acid value of the prepared styrene-acrylic acid-based resin can be adjusted by adjusting the additive amount of the acrylic acid-based monomer that is used in preparation of the styrene-acrylic acid-based resin.

In a situation in which the styrene-acrylic acid-based resin is used as the binder resin of the toner cores, the styrene-acrylic acid-based resin preferably has a number average molecular weight (Mn) of at least 2,000 and no greater than 3,000 in order to improve toner core strength and toner fixability. The styrene-acrylic acid-based resin preferably has a molecular weight distribution (i.e., a ratio Mw/Mn of mass average molecular weight (Mw) relative to number average molecular weight (Mn)) of at least 10 and no greater than 20. The mass average molecular weight (Mn) and the number average molecular weight (Mw) of the styrene-acrylic acid-based resin can be measured by gel permeation chromatography.

The following explains a polyester resin that can be used as the binder resin. The polyester resin can be prepared through condensation polymerization or condensation copolymerization of a di-, tri-, or higher-hydric alcohol with a di-, tri-, or higher-basic carboxylic acid.

The polyester resin can for example be prepared using a di-hydric alcohol such as a diol or a bisphenol.

Examples of preferable diols that can be used in preparation of the polyester resin include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols that can be used in preparation of the polyester resin include bisphenol A, hydrogenated bisphenol A, polyoxyethylene bisphenol A ether, and polyoxypropylene bisphenol A ether.

Preferable examples of tri- or higher-hydric alcohols that can be used in preparation of the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids that can be used in preparation of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-hydric carboxylic acids that can be used in preparation of the polyester resin include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, and EMPOL trimer acid.

Alternatively, an ester-forming derivative (specific examples include acid halides, acid anhydrides, and lower alkyl esters) of any of the di-, tri-, or higher-basic carboxylic acids listed above may be used. The term "lower alkyl" refers to an alkyl group having a carbon number of at least 1 and no greater than 6.

The acid value and the hydroxyl value of the polyester resin can be adjusted by adjusting the amounts of alcohol and carboxylic acid used in preparation of the polyester resin. An increase in the molecular weight of the polyester resin tends to cause a decrease in the acid value and the hydroxyl value of the polyester resin.

In a situation in which the polyester resin is used as the binder resin of the toner cores, the polyester resin preferably has a number average molecular weight (Mn) of at least 1,000 and no greater than 2,000 in order to improve toner core strength and toner fixability. The polyester resin preferably has a molecular weight distribution (i.e., a ratio Mw/Mn of mass average molecular weight (Mw) relative to number average molecular weight (Mn)) of at least 9 and no greater than 21. The number average molecular weight (Mn) and the mass average molecular weight (Mw) of the polyester resin can be measured by gel permeation chromatography.

(Toner Core Colorant)

The toner cores may optionally contain a colorant. The colorant can be a commonly known pigment or dye that matches the color of the toner. In order that an image having high image quality can be formed using the toner, the amount of the colorant is preferably at least 1 part by mass and no greater than 20 parts by mass relative to 100 parts by mass of the binder resin, and more preferably at least 3 parts by mass and no greater than 10 parts by mass.

The toner cores may optionally contain a black colorant. The black colorant may for example be carbon black. In another example, the black colorant may be a colorant that is adjusted to a black color using a yellow colorant, a magenta colorant, and a cyan colorant.

The toner cores may optionally contain a non-black colorant such as a yellow colorant, a magenta colorant, or a cyan colorant.

The yellow colorant can for example be one or more compounds selected from the group consisting of condensed azo compounds, isoindolinone compounds, anthraquinone compounds, azo metal complexes, methine compounds, and arylamide compounds. Specific examples of preferable yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

The magenta colorant can for example be one or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of preferable magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorant can for example be one or more compounds selected from the group consisting of copper phthalocyanine compounds, anthraquinone compounds, and basic dye lake compounds. Specific examples of preferable cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

(Toner Core Releasing Agent)

The toner cores may optionally contain a releasing agent. The releasing agent is for example used in order to improve fixability of the toner or resistance of the toner to being offset. In order to improve anionic strength of the toner cores, the toner cores are preferably prepared using an anionic wax. In order to improve toner fixability or offset resistance, the amount of the releasing agent is preferably at least 1 part by mass and no greater than 30 parts by mass relative to 100 parts by mass of the binder resin, and more preferably at least 5 parts by mass and no greater than 20 parts by mass.

Examples of preferable releasing agents that can be used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester has been partially or fully deoxidized such as deoxidized carnauba wax. A single releasing agent may be used or a combination of two or more releasing agents may be used.

A compatibilizer may optionally be added to the toner cores in order to improve compatibility of the binder resin and the releasing agent.

(Toner Core Charge Control Agent)

The toner cores may optionally contain a charge control agent. The charge control agent is for example used in order to improve charge stability or a charge rise characteristic of the toner. Anionic strength of the toner cores can be increased by including a negatively chargeable charge control agent in the toner cores. The charge rise characteristic of the toner is an indicator as to whether the toner can be charged to a specific charge level in a short period of time.

A positively chargeable charge control agent is preferably used in a situation in which development is performed using a positively charged toner, whereas a negatively chargeable charge control agent is preferably used in a situation in which development is performed using a negatively charged toner. However, it is not essential to use a charge control agent if sufficient chargeability of the toner can be ensured without the charge control agent. For example, it may not be necessary to add a charge control agent to the toner cores in a situation in which the shell layers contain a chargeable component.

Preferable examples of positively chargeable charge control agents include: azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; azine compounds (specific examples include direct dyes) such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; nigrosine compounds (specific examples include acid dyes) such as Nigrosine BK, Nigrosine NB, and Nigrosine Z; metal salts of naphthenic acids and metal salts of higher fatty acids; alkoxylated amines; alkylamides; and quaternary ammonium salts such as benzyldecylhexylmethyl ammonium chloride and decyltrimethyl ammonium chloride. A resin including a repeating unit that has a carboxyl group can also be used as a positively chargeable charge control agent. Furthermore, a resin including a repeating unit that originates from a quaternary ammonium salt or a carboxylic acid salt can be used as a positively chargeable charge control agent. Nigrosine compounds are particularly preferable for achieving rapid charge rise. A single charge control agent may be used or a combination of two or more charge control agents may be used.

(Toner Core Magnetic Powder)

The toner cores may optionally contain a magnetic powder. Examples of preferable magnetic powders that can be used include iron (specific examples include ferrite and magnetite), ferromagnetic metals (specific examples include cobalt and nickel), alloys of either or both of iron and ferromagnetic metals, ferromagnetic alloys subjected to ferromagnetization (specific examples include heat treatment), and chromium dioxide. A single type of magnetic powder may be used or a combination of two or more types of magnetic powder may be used.

The magnetic powder is preferably subjected to surface treatment in order to inhibit elution of metal ions (for example, iron ions) from the magnetic powder. In a situation in which the shell layers are formed on the surface of the toner cores under acidic conditions, elution of metal ions to the surface of the toner cores causes the toner cores to have a greater tendency to adhere to one another. It is thought that adhesion of the toner cores to one another can be inhibited by inhibiting elution of metal ions from the magnetic powder.

[Shell Layers]

The shell layers may be composed substantially of a thermosetting resin, may be composed substantially of a thermoplastic resin, or may contain both a thermoplastic resin and a thermosetting resin. In the shell layers, a thermoplastic resin may be cross-linked by a cross-linking monomer or prepolymer (for example, monomers described below that can be used in preparation of a thermosetting resin). The ratio of thermoplastic resin and thermosetting resin may be any appropriate value. The ratio of thermoplastic resin and thermosetting resin (thermoplastic resin: thermosetting resin mass ratio) may for example be 1:1, 1:2, 1:3, 1:4, 1:5, 2:1, 3:1, 4:1, or 5:1.

Examples of preferable thermosetting resins that can be contained in the shell layers include melamine resins, urea resins, sulfonamide resins, glyoxal resins, guanamine resins, aniline resins, polyimide resins, and derivatives of any of the aforementioned resins. A polyimide resin includes nitrogen atoms in a molecular backbone thereof. Therefore, shell layers containing a polyimide resin tend to be strongly cationic. Examples of preferable polyimide resins that can be contained in the shell layers include maleimide-based polymers and bismaleimide-based polymers (specific examples include amino-bismaleimide polymers and bismaleimide-triazine polymers).

In order to improve positive chargeability and high-temperature preservability of the toner, the shell layers are preferably substantially composed of a resin resulting from polycondensation of a compound having an amino group and an aldehyde (for example, formaldehyde). Specific examples include melamine-based resins, urea-based resins, and glyoxal-based resins. A melamine resin is a polycondensate of melamine and formaldehyde. A urea resin is a polycondensate of urea and formaldehyde. A glyoxal resin is a polycondensate of formaldehyde and a reaction product of glyoxal and urea. It is thought that the toner tends not to aggregate during drying in a situation in which the shell layers contain a melamine resin or a urea resin. The above is a result of melamine resins and urea resins having low water-absorption. Therefore, it is preferable for the shell layers to contain a melamine resin or a urea resin in order to improve toner preservability.

The thermosetting resin contained in the shell layers is preferably prepared using one or more monomers selected from the group consisting of methylol melamine, benzoguanamine, acetoguanamine, spiroguanamine, and dimethylol dihydroxyethyleneurea (DMDHEU).

Cross-link curing by the thermosetting resin can be improved through inclusion of nitrogen atoms in the thermosetting resin. In order to increase reactivity of the thermosetting resin, nitrogen content is preferably adjusted to at least 40% by mass and no greater than 55% by mass for a melamine resin, approximately 40% by mass for a urea resin, and approximately 15% by mass for a glyoxal resin.

The thermoplastic resin contained in the shell layers preferably has a functional group (for example, a hydroxyl group, a carboxyl group, an amino group, a carbodiimide group, an oxazoline group, or a glycidyl group) that readily reacts with a functional group of the thermosetting resin (for example, a methylol group or an amino group). The thermoplastic resin may have an amino group in the form of a carbamoyl group (—$CONH_2$).

The thermoplastic resin contained in the shell layers is preferably a hydrophilic resin and particularly preferably is a hydrophilic resin including a repeating unit originating from a monomer having a polar functional group (for example, glycol, a carboxylic acid, or maleic acid). A thermoplastic resin having a polar functional group has a high reactivity. Preferable examples of hydrophilic thermoplastic resins that can be contained in the shell layers include polyvinyl alcohol, polyvinylpyrrolidone, carboxymethyl cellulose and derivatives thereof, sodium polyacrylate, polyacrylamide, polyethylenimine, and polyethylene oxide.

In a situation in which the shell layers contain both a thermoplastic resin and a thermosetting resin, the thermoplastic resin contained in the shell layers preferably includes a repeating unit originating from an acrylic acid-based monomer, and more preferably includes a repeating unit originating from a highly reactive ester of acrylic acid. Use of a thermoplastic resin including a repeating unit originating from an acrylic acid-based monomer is thought to improve film quality of the shell layers as a result of the thermoplastic resin reacting readily with the thermosetting resin. The thermoplastic resin contained in the shell layers particularly preferably includes a repeating unit originating from 2HEMA (2-hydroxyethylmethacrylate).

Preferable examples of thermoplastic resins that can be contained in the shell layer include acrylic acid-based resins, styrene-acrylic acid-based copolymers, silicone-acrylic acid-based graft copolymers, urethane resins, polyester resins, and ethylene-vinyl alcohol copolymers. The thermoplastic resin contained in the shell layers is preferably an acrylic acid-based resin, a styrene-acrylic acid-based copolymer, or a silicone-acrylic acid-based graft copolymer, with an acrylic acid-based resin being particularly preferable.

Preferable acrylic acid-based monomers that can be used in preparation of the thermoplastic resin contained in the shell layers include: (meth)acrylic acid; alkyl esters of (meth)acrylic acid such as methyl(meth)acrylate, ethyl (meth)acrylate, n-propyl(meth)acrylate, and n-butyl(meth) acrylate; aryl esters of (meth)acrylic acid such as phenyl (meth)acrylate; hydroxyalkyl esters of (meth)acrylic acid such as 2-hydroxyethyl(meth)acrylate, 3-hydroxypropyl (meth)acrylate, 2-hydroxypropyl(meth)acrylate, and 4-hydroxybutyl(meth)acrylate; (meth)acrylamide; ethylene oxide adducts of (meth)acrylic acid; and alkyl ethers (specific examples include methyl ethers, ethyl ethers, n-propyl ethers, and n-butyl ethers) of ethylene oxide adducts of (meth)acrylic acid esters. A single type of acrylic acid-based monomer may be used or a combination of two or more types of acrylic acid-based monomers may be used.

The material of the shell layers is not limited to the materials described above and may be any appropriate material. For example, the shell layers may include gelatin/gum arabic.

In a situation in which the shell layers are substantially composed of a thermosetting resin, the shell layers preferably have a thickness of at least 1 nm and no greater than 30 nm. In a situation in which the shell layers contain both a thermosetting resin and a thermoplastic resin, the shell layers preferably have a thickness of at least 20 nm and no greater than 45 nm. It is thought that a toner including toner particles that have shell layers with a thickness such as described above has excellent fixability and preservability. The thickness of the shell layers can be measured by analyzing TEM images of toner particle cross-sections using commercially available image analysis software (for example, WinROOF produced by Mitani Corporation). In a situation in which a toner particle does not have a uniform shell layer, the thickness of the shell layer is measured at four equally spaced locations (more specifically, four locations at which the shell layer is intersected by two straight lines that intersect one another perpendicularly at approximately the center of the toner particle cross-section) and an arithmetic mean value of the four measured values is used as an evaluation value (i.e., shell layer thickness) for the toner particle.

[External Additive]

An external additive may optionally be caused to adhere to the surface of the toner mother particles. The external additive is for example used in order to improve fluidity or handleability of the toner. In order to improve fluidity or handleability of the toner, the amount of the external additive is preferably at least 0.5 parts by mass and no greater than 10 parts by mass relative to 100 parts by mass of the toner mother particles, and more preferably at least 1.5 parts by mass and no greater than 5 parts by mass. Also, in order to improve fluidity or handleability of the toner, the external additive preferably has a particle size of at least 0.01 μm and no greater than 1.0 μm.

Examples of preferable external additives that can be used include silica particles and particles of metal oxides (specific examples include alumina, titanium oxide, magnesium oxide, zinc oxide, strontium titanate, and barium titanate). A single external additive may be used or a combination of two or more external additives may be used.

[Carrier]

The carrier included in the two-component developer according to the present embodiment has feature (3) described further above. Particles of the carrier are preferably magnetic carrier particles. In a preferable example of magnetic carrier particles, each of the carrier particles includes a carrier core containing a magnetic material and a coating layer that coats the carrier core.

Preferable examples of magnetic materials that can be contained in the carrier cores include metal oxides such as ferrites (specific examples include ferromagnetic ferrites and magnetite), iron family elements (specifically, iron, nickel, and cobalt), and alloys of an iron family element and copper, zinc, antimony, aluminum, lead, tin, bismuth, beryllium, manganese, magnesium, selenium, tungsten, zirconium, or vanadium. Furthermore, a metal oxide (specific examples include iron oxide, titanium oxide, and magnesium oxide), a nitride (specific examples include chromium nitride and vanadium nitride), or a carbide (specific examples include silicon carbide and tungsten carbide) may be mixed with an iron family element and the resultant mixture (magnetic material) may be used as a material of the carrier cores. Among the magnetic materials described above, a ferrite is particularly preferable as a material of the carrier cores. A single material may be used or a combination of two or more materials may be used.

In order to improve developing properties of the two-component developer, the carrier cores preferably have a volume median diameter ($D_{50}$) of at least 30 μm and no greater than 100 μm. The volume median diameter ($D_{50}$) of the carrier cores can for example be measured using a laser diffraction/scattering particle size distribution analyzer (LA-700 produced by Horiba, Ltd.).

Examples of preferable materials that can be used for the coating layers that coat the carrier cores include olefin-based resins (specific examples include polyethylene, polypropylene, chlorinated polyethylene, and chlorosulfonated polyethylene), acrylic acid-based resins (specific examples include methyl methacrylate resin), styrene-based resins, acrylonitrile-based resins, amino resins (specific examples include urea-formaldehyde resins), polyamide resins, urethane resins, polycarbonates, silicone resins including organopolysiloxanes, silicone modified resins (specific examples include silicone modified alkyd resins, silicone modified polyester resins, silicone modified epoxy resins, and silicone modified urethane resins), fluorine-containing resins (specific examples include polytetrafluoroethylene, polyvinyl fluoride, polyvinylidene fluoride, polychlorotrifluoroethylene, and tetrafluoroethylene-hexafluoropropylene copolymers), vinyl resins (specific examples include polyvinyl acetate, polyvinyl alcohol, polyvinyl butyral, polyvinyl chloride, polyvinyl carbazole, polyvinyl ethers, polyvinyl ketones, and vinyl chloride-vinyl acetate copolymers), polyester resins, and epoxy resins.

In order to improve developing properties of the two-component developer, in the carrier particles, the carrier cores preferably contain a ferrite and the coating layers are preferably substantially composed of a fluorine-containing resin. A mass ratio of the coating layers relative to the carrier cores is preferably at least 2 parts by mass and no greater than 6 parts by mass of the coating layers relative to 100 parts by mass of the carrier cores.

The coating layers may optionally contain a conductive material in order to adjust electrical resistance of the coating layers. For example, a conductive material may be dispersed in the coating layers. Preferable examples of conductive materials that can be used include carbon black (specific examples include Acetylene Black), carbides (specific examples include SiC), magnetic materials (specific examples include magnetite), $SnO_2$, and Titanium Black. In order to disperse the conductive material uniformly in the coating layers, the conductive material preferably has a particle size of at least 0.01 μm and no greater than 2.0 μm, and more preferably at least 0.01 μm and no greater than 1.0 μm. The additive amount of the conductive material is preferably no greater than 4 parts by mass relative to 1,000 parts by mass of the coating layers.

[Toner Production Method]

The following explains an example of a method for producing the toner contained in the two-component developer according to the present embodiment. First, toner cores are prepared. Next, the toner cores and a shell material are added into a liquid. When adding the toner cores and the shell material, the liquid is preferably stirred in order to dissolve or disperse the shell material. Next, shell layers are formed over the surface of the toner cores in the liquid (i.e., curing of the shell layers is performed). In order to inhibit dissolution or elution of components of the toner cores (in particular, the binder resin and the releasing agent) during formation of the shell layers, the shell layers are preferably formed in an aqueous medium. Also, in order to form shell layers containing a melamine-based resin or a urea-based resin, the toners cores are preferably added into an aqueous medium having a methylolated compound dissolved therein, and film formation of the melamine-based resin or the urea-based resin is then caused to occur over the surface of the toner cores. The aqueous medium is a medium having water as a main component (specific examples include pure water and a mixture of water and a polar medium). The aqueous medium may function as a solvent. A solute may be dissolved in the aqueous medium. The aqueous medium may function as a dispersion medium. A dispersoid may be dispersed in the aqueous medium. Examples of polar mediums that can be included in the aqueous medium include alcohols (specific examples include methanol and ethanol).

The following explains the method of producing the toner through a more specific example. Ion exchanged water is for example prepared as the aforementioned liquid. Next, the pH of the liquid is adjusted using, for example, hydrochloric acid. After pH adjustment, the shell material is added into the liquid. The shell material is dissolved in the liquid to yield a shell material solution. An appropriate additive amount of the shell material can be calculated based on the specific surface area of the toner cores. Also, the charge decay constant of the toner in an external additive-free state can be adjusted based on the additive amount of the shell material.

Next, the toner cores are added into the resultant shell material solution. In order that the shell material adheres uniformly to the surface of the toner cores, the toner cores are preferably dispersed to a high degree in the shell material solution. A dispersant may be added to the liquid in order to enable a high degree of dispersion of the toner cores.

Examples of preferable dispersants that can be used include sodium polyacrylate, polyparavinyl phenol, partially saponified polyvinyl acetate, isoprene sulfonic acid, polyethers, isobutylene/maleic anhydride copolymer, sodium polyaspartate, starch, gum arabic, polyvinylpyrrolidone, and sodium ligninesulfonate. A single dispersant may be used or a combination of two or more dispersants may be used. In order to inhibit detachment of the shell layers from the toner cores, the amount of the dispersant is preferably no greater than 75 parts by mass relative to 100 parts by mass of the toner cores.

Next, the temperature of the solution is raised to a specific shell layer curing temperature (for example, a selected temperature that is at least 60° C. and no greater than 80° C.) at a specific rate (for example, a selected rate that is at least 0.1° C./minute and no greater than 3° C./minute) while stirring the solution. The temperature of the solution is then maintained at the shell layer curing temperature for a specific period of time (for example, a selected time that is at least 30 minutes and no greater than 2 hours) while stirring the solution. Through the above process, the shell material becomes adhered to the surface of the toner cores and the adhered shell material is cured through a polymerization reaction. A dispersion of toner mother particles is obtained as a result.

In order to inhibit elution of toner core components or deformation of the toner cores, the shell material curing temperature (i.e., the temperature of the shell material solution during curing of the shell layers) is preferably lower than a glass transition point (Tg) of the toner cores. However, the shell layer curing temperature may be set as equal to or greater than the glass transition point (Tg) of the toner cores in order to intentionally cause deformation of the toner cores. A higher solution temperature during shell layer curing promotes deformation of the toner cores and tends to lead to toner mother particles that are more circular in shape. The solution temperature during shell layer curing is preferably determined in order to enable formation of toner mother particles having a desired shape. Furthermore, reaction of the shell material at high temperature tends to result in hard shell layers. In a situation in which the shell layers are substantially composed of either or both of a melamine-based resin and a urea-based resin, the shell layer curing temperature is preferably at least 40° C. and no greater than 80° C., and more preferably at least 55° C. and no greater than 70° C. It is also possible to control the molecular weight of the shell layers based on the solution temperature during shell layer curing.

Once the shell layers have been cured as described above, the toner mother particle dispersion is neutralized using, for example, sodium hydroxide. Next, the resultant liquid is cooled. The cooled liquid is then filtered. Through the above process, the toner mother particles are separated from the liquid (solid-liquid separation). Next, the resultant toner mother particles are washed. The washed toner mother particles are then dried. After drying, an external additive may be caused to adhere to the surface of the toner mother particles depending on necessity of the external additive. The above completes production of a toner including a large number of toner particles. The toner production method described above may be altered as appropriate in accordance with requirements of the toner, such as in terms of composition and properties. In an alternative example, a step of adding the toner cores to the solvent may be performed prior to a step of dissolving the shell material in the solvent. The shell layers may be formed by any appropriate process. The shell layers may for example be formed through any of an in-situ polymerization process, an in-liquid curing film coating process, or a coacervation process. Furthermore, non-essential steps may be omitted. In a situation in which an external additive is not caused to adhere to the surface of the toner mother particles (i.e., external addition is omitted), the toner mother particles and the toner particles are equivalent. In order to efficiently produce the toner, preferably a large number of toner particles are formed at the same time.

The two-component developer according to the present embodiment can be produced by stirring a mixture of the produced toner and a carrier. The amount of the toner included in the two-component developer is preferably at least 1 part by mass and no greater than 20 parts by mass relative to 100 parts by mass of the carrier, and more preferably at least 3 parts by mass and no greater than 15 parts by mass. Stirring of the mixture can for example be performed by a ball mill, a Nauta mixer (registered Japanese trademark) produced by Hosokawa Micron Corporation, or a Rocking Mixer (registered Japanese trademark) produced by Aichi Electric Co., Ltd.

[Examples]

The following explains Examples of the present disclosure. Table 1 shows details of developers A-G (two-component developers for electrostatic latent image development) according to Examples and Comparative Examples.

TABLE 1

| | Toner charge decay constant | | | | Carrier Volume |
|---|---|---|---|---|---|
| | First (yellow) | Second (cyan) | Third (magenta) | Fourth (black) | resistivity (Ω · cm) |
| Developer A | 0.050 | 0.040 | 0.030 | 0.020 | 1.00E+12 |
| Developer B | 0.050 | 0.040 | 0.030 | 0.020 | 1.00E+15 |
| Developer C | 0.020 | 0.020 | 0.020 | 0.020 | 1.00E+12 |
| Developer D | 0.050 | 0.050 | 0.050 | 0.050 | 1.00E+12 |
| Developer E | 0.015 | 0.015 | 0.015 | 0.015 | 1.00E+12 |
| Developer F | 0.055 | 0.055 | 0.055 | 0.055 | 1.00E+12 |
| Developer G | 0.050 | 0.040 | 0.030 | 0.020 | 1.00E+10 |

The following explains, in order, a production method, an evaluation method, and evaluation results for each of developers A-G. In evaluations in which errors may occur, an evaluation value was calculated by calculating the arithmetic mean of an appropriate number of measured values in order to ensure that any error was sufficiently small.

[Production Method of Developer A]

(Toner Core Preparation)

Toners of four different colors (yellow, cyan, magenta, and black) were prepared in order to produce developers A of the four colors. Also, in order to produce the four different color toners, toner cores of the fours colors containing different colorants were produced according to the following procedure.

First, 100 parts by mass of a binder resin, 5 parts by mass of a releasing agent, 5 parts by mass of a colorant, and 1 part by mass of a charge control agent were mixed using an FM mixer (product of Nippon Coke & Engineering Co., Ltd.).

The binder resin was a polyester resin (XPE258 produced by Mitsui Chemicals, Inc.). The releasing agent was a polypropylene wax (VISCOL (registered Japanese trademark) 660P produced by Sanyo Chemical Industries, Ltd.). The charge control agent was a quaternary ammonium salt (BONTRON (registered Japanese trademark) P-51 produced by Orient Chemical Industries, Co., Ltd.).

Different colorants were used in accordance with the intended color of the toner cores. In production of yellow toner cores, the colorant was an azo pigment. In production of cyan toner cores, the colorant was a phthalocyanine pigment. In production of magenta toner cores, the colorant was a quinacridone pigment. In production of black toner cores, the colorant was carbon black.

Next, the resultant mixture was melt-kneaded using a twin screw extruder (PCM-30 produced by Ikegai Corp.). The resultant melt-knead was then cooled.

The kneaded product was subsequently pulverized using a mechanical pulverizer (Turbo Mill T250 produced by Freund-Turbo Corporation). Next, the pulverized product was classified using a classifier (Elbow Jet EJ-LABO produced by Nittetsu Mining Co., Ltd.). Toner cores having a volume median diameter ($D_{50}$) of 7 μm were obtained as a result of the above process. The volume median diameter was measured using a Coulter Counter Multisizer 3 produced by Beckman Coulter, Inc.

The toner cores had a zeta potential at pH 4 of −30 mV and a triboelectric charge of −25 μC/g. The measured values for the zeta potential and the triboelectric charge clearly indicate that the toner cores were anionic. The zeta potential and the triboelectric charge of the toner cores were measured as described below.

<Measurement Method of Toner Core Zeta Potential>

A magnetic stirrer was used to mix 0.2 g of the toner cores, 80 g of ion exchanged water, and 20 g of 1% by mass concentration non-ionic surfactant (K-85 produced by Nippon Shokubai Co., Ltd., polyvinylpyrrolidone). A dispersion was obtained by uniformly dispersing the toner cores in the liquid. Next, the resultant dispersion was adjusted to pH 4 though addition of dilute hydrochloric acid to yield a pH 4 toner core dispersion. The zeta potential of the toner cores was then measured using the pH 4 toner core dispersion as a measurement sample. Specifically, the zeta potential of the toner cores in the measurement sample was measured using a zeta potential/particle size distribution analyzer (Delsa Nano HC produced by Beckman Coulter, Inc.).

<Measurement Method of Toner Core Triboelectric Charge>

A mixer (TURBULA (registered Japanese trademark) Mixer produced by Willy A. Bachofen (WAB) AG) was used to mix 100 parts by mass of a standard carrier N-01 (standard carrier for use with negative-charging toner) provided by The Imaging Society of Japan and 7 parts by mass of the toner cores for 30 minutes. The triboelectric charge of the toner cores was measured using the resultant mixture as a measurement sample. Specifically, with respect to the measurement sample, the triboelectric charge of the toner cores when friction was caused between the toner cores and the standard carrier was measured using a Q/m meter (MODEL 210HS produced by Trek, Inc.).

(Shell Layer Formation)

A three-necked flask equipped with a thermometer and a stirring impeller, and having a capacity of 1 L was set up in a water bath. The water bath was used to maintain the internal temperature of the flask at 30° C. Next, 300 mL of ion exchanged water adjusted to pH 4, 50 g of sodium polyacrylate (JURYMER (registered Japanese trademark) AC-103 produced by Toagosei Co., Ltd.), and methylol urea aqueous solution (MIRBANE (registered Japanese trademark) Resin SUM-100 produced by Showa Denko K.K., solid concentration 80% by mass) were added into the flask. The pH of the ion exchanged water was adjusted using hydrochloric acid. The additive amount of the shell material (i.e., MIRBANE Resin SUM-100) was adjusted in accordance with the color of the toner. Specifically, the additive amount of the shell material (MIRBANE Resin SUM-100) was 24 g in production of the yellow toner, 18 g in production of the cyan toner, 12 g in production of the magenta toner, and 6 g in production of the black toner.

The methylol urea was dissolved in the ion exchanged water. Next, 300 g of the toner cores (powder) produced according to the procedure described above were added into the resultant aqueous solution. The flask contents were than sufficiently stirred at room temperature. As a result, a toner core dispersion was obtained in the flask.

Next, the toner core dispersion was transferred into a separable flask having a capacity of 1 L. The internal temperature of the flask was subsequently raised to 70° C. (polymerization temperature) at a heating rate of 0.5° C./minute while stirring the flask contents at a rotational speed of 100 rpm. After reaching 70° C., the internal temperature of the flask was maintained at 70° C. for 2 hours while stirring the flask contents at a rotational speed of 100 rpm. A dispersion containing toner mother particles was obtained as a result. Next, the toner mother particle dispersion was cooled to room temperature (approximately 25° C.) and was adjusted to pH 7 (i.e., neutralized) using sodium hydroxide.

(Toner Mother Particle Washing and Drying)

The toner mother particles were obtained from the toner mother particle dispersion, prepared as described above, by filtration (solid-liquid separation) of the toner mother particle dispersion. The obtained toner mother particles were then redispersed in ion exchanged water. Dispersion and filtration were further repeated in order to wash the toner mother particles. Next, the toner mother particles were dried.

The charge decay constant of the toner in an external additive-free state (i.e., the charge decay constant of the toner mother particles) was measured according to the method described below. The charge decay constant of the toner in the external additive-free state was 0.050 for the yellow toner, 0.040 for the cyan toner, 0.030 for the magenta toner, and 0.020 for the black toner.

<Measurement Method of Toner Charge Decay Constant in External Additive-Free State>

The charge decay constant α of the toner in the external additive-free state (i.e., the charge decay constant of the toner mother particles) was measured by a method in accordance with JIS C 61340-2-1 using an electrostatic dissipation measuring device (NS-D100 produced by Nano Seeds Corporation). The following provides detailed description of the method of measuring the charge decay constant of the toner in the external additive-free state.

A sample (i.e., the toner mother particles) was added into a measurement cell. The measurement cell was a metal cell having a recess of internal diameter 10 mm and depth 1 mm. The sample was loaded into the recess of the cell, pressing on the sample from above using slide glass. Any of the sample that overflowed from the cell was removed by moving the slide glass back and forth on the surface of the cell. At least 0.04 g and no greater than 0.06 g of the sample was loaded into the cell.

Next, the measurement cell having the sample loaded therein was left for 12 hours in ambient conditions of 32.5° C. and 80% relative humidity. The grounded measurement cell was subsequently placed in the electrostatic dissipation measuring device and ions were supplied to the sample by corona discharge, charging the sample. The surface potential of the sample was measured continuous starting from 0.7 s after completion of corona discharge. The charge decay constant (charge decay rate) a was calculated based on the surface potential measurements and the equation $V=V_0\exp(-\alpha\sqrt{t})$. In the above equation, V represents surface potential [V], $V_0$ represents initial surface potential [V], and t represents decay time [s].

(External Addition)

After drying the toner mother particles as described above, the toner mother particles were subjected to external addition treatment. Specifically, 100 parts by mass of the toner mother particles, 1 part by mass of hydrophobic silica particulate (RA-200H produced by Nippon Aerosil Co., Ltd.), and 1 part by mass of conductive titanium oxide particulate (EC-100 produced by Titan Kogyo, Ltd.) were mixed for 5 minutes at a rotational speed of 3,500 rpm using an FM mixer (FM-10B produced by Nippon Coke & Engineering Co., Ltd.) in order to cause external additive (silica particles and titanium oxide particles) to adhere to the surface of the toner mother particles. Next, the resultant toner was sifted using a 200 mesh (opening size 75 μm) sieve. Through the above process, a toner including a large number of toner particles was produced.

(Toner and Carrier Mixing)

The toner produced as described above was mixed with a carrier produced according to the following method such that a concentration of the toner in the two-component developer was 10% by mass and the resultant mixture was stirred for 1 hour using a powder stirrer (Rocking Mixer (registered Japanese trademark) produced by Aichi Electric Co.). The carrier had a volume resistivity of $1.0\times10^{12}$ Ω·cm. Developers A (two-component developers) of the four colors (yellow, cyan, magenta, and black) were obtained through the above process.

<Carrier Production Method>

Carrier cores were sprayed with a liquid of tetrafluoroethylene-hexafluoropropylene copolymer (FEP) dispersed in the methyl ethyl ketone (referred to below as an FEP dispersion) using a flow coating device. As a result, the surface of the carrier cores was coated with an uncured organic layer (flow layer). The carrier cores were manganese-containing ferrite particles having a particle size of 40 μm and a saturation magnetization of 65 $Am^2/kg$ ($3000\times10^3/4\pi$·A/m during application). The amount of the FEP dispersion was 5 parts by mass relative to 100 parts by mass of the carrier cores.

Next, heat treatment was performed for 1 hour at 280° C. to cure the flow layer. As a result of the above process, a carrier including carrier cores and resin layers (coating layers) coating the carrier cores was obtained. The carrier had a volume resistivity of $1.0\times10^{12}$ Ω·cm. The volume resistivity of the carrier was measured using an Ultra High Resistance Meter produced by Advantest Corporation with an applied voltage of 1,000 V.

[Production Method of Developer B]

Developer B was produced according to the same method as developer A in all aspects other than that a coating amount (amount of FEP dispersion) in preparation of the carrier was increased. The carrier in developer B had a volume resistivity of $1.0\times10^{15}$ Ω·cm.

[Production Method of Developer C]

Developer C was produced according to the same method as developer A in all aspects other than that the additive amount of the shell material (MIRBANE Resin SUM-100) was 6 g instead of 24 g in production of the yellow toner, 6 g instead of 18 g in production of the cyan toner, and 6 g instead of 12 g in production of the magenta toner; the additive amount in production of the black toner was unchanged as 6 g. The charge decay constant of the toner in the external additive-free state was 0.020 for the yellow toner, 0.020 for the cyan toner, 0.020 for the magenta toner, and 0.020 for the black toner.

[Production Method of Developer D]

Developer D was produced according to the same method as developer A in all aspects other than that the additive amount of the shell material (MIRBANE Resin SUM-100) was 24 g instead of 18 g in production of the cyan toner, 24 g instead of 12 g in production of the magenta toner, and 24 g instead of 6 g in production of the black toner; the additive amount in production of the yellow toner was unchanged as 24 g. The charge decay constant of the toner in the external additive-free state was 0.050 for the yellow toner, 0.050 for the cyan toner, 0.050 for the magenta toner, and 0.050 for the black toner.

[Production Method of Developer E]

Developer E was produced according to the same method as developer A in all aspects other than that the additive amount of the shell material (MIRBANE Resin SUM-100) was 3 g instead of 24 g in production of the yellow toner, 3 g instead of 18 g in production of the cyan toner, 3 g instead of 12 g in production of the magenta toner, and 3 g instead of 6 g in production of the black toner. The charge decay constant of the toner in the external additive-free state was 0.015 for the yellow toner, 0.015 for the cyan toner, 0.015 for the magenta toner, and 0.015 for the black toner.

[Production Method of Developer F]

Developer F was produced according to the same method as developer A in all aspects other than that the additive amount of the shell material (MIRBANE Resin SUM-100) was 27 g instead of 24 g in production of the yellow toner, 27 g instead of 18 g in production of the cyan toner, 27 g instead of 12 g in production of the magenta toner, and 27 g instead of 6 g in production of the black toner. The charge decay constant of the toner in the external additive-free state was 0.055 for the yellow toner, 0.055 for the cyan toner, 0.055 for the magenta toner, and 0.055 for the black toner.

[Production Method of Developer G]

Developer G was produced according to the same method as developer A in all aspects other than that a coating amount (amount of FEP dispersion) in preparation of the carrier was decreased. The carrier in developer G had a volume resistivity of $1.0\times10^{10}$ Ω·cm.

[Evaluation Method]

Each of the samples (developers A-G) was evaluated according to the method described below.

(Image Density, Toner Scattering, and Electrostatic Offset)

Image density, toner scattering, and electrostatic offset were evaluated by using the sample (two-component developer) to form perform image formation. A color multifunction peripheral (TASKalfa 500ci produced by KYOCERA Document Solutions Inc.) was used as an evaluation apparatus. The sample (two-component developer) was loaded into a developing device of the evaluation apparatus and the toner of the sample (two-component developer) was loaded into a toner container of the evaluation device as toner for replenishment use. More specifically, the evaluation apparatus had four developing devices (first to fourth developing devices). The first to fourth developing devices were arranged with the first developing device located furthest upstream in terms of primary transfer (i.e., at a position where primary transfer occurs earliest), and the second, third, and fourth developing devices located, in order, progressively further downstream in terms of primary transfer (i.e., at positions where primary transfer occurs later). A yellow sample (two-component developer) was loaded into the first developing device, a cyan sample (two-component developer) was loaded into the second developing device, a magenta sample (two-component developer) was loaded into the third developing device, and a black sample (two-component developer) was loaded into the fourth developing device.

In order to evaluate image density, toner scattering, and electrostatic offset, the evaluation apparatus was used to form an evaluation image on evaluation paper (Color Copy (registered Japanese trademark) produced by Mondi, A4 size, 90 $g/m^2$). The evaluation image included a solid section having a coverage of 100%, a halftone section having a coverage of 50%, and a text section.

The following explains a method by which image density was evaluated for each sample (two-component developer). In order to evaluate image density of each sample (two-component developer), the evaluation apparatus was used to print the evaluation image consecutively on 100 sheets of the evaluation paper and the solid and halftone sections of the printed evaluation images were evaluated for uniformity of image density (uniformity within the image). The following evaluation standard was used.

Poor: Low image density uniformity and poor image quality in at least one evaluation image Good: High image density uniformity and good image quality in every evaluation image Particularly Good: Particularly high image density uniformity and particularly good image quality in every evaluation image The following explains a method by which toner scattering (transfer scattering) was evaluated for each sample (two-component developer). In order to evaluate toner scattering of each sample (two-component developer), the evaluation apparatus was used to print the evaluation image consecutively on 100 sheets of the evaluation paper and the printed evaluation images (mainly the text sections) were evaluated for toner scattering. The following evaluation standard was used.

Poor: Obvious toner scattering and poor image quality in at least one evaluation image Good: Good image quality in every evaluation image but slight toner scattering in at least one evaluation image Particularly Good: No toner scattering in any evaluation image and particularly good image quality in every evaluation image The following explains a method by which electrostatic offset was evaluated for each sample (two-component developer). In order to evaluate electrostatic offset of each sample (two-component developer), the evaluation apparatus was used to print the evaluation image consecutively on 100 sheets of the evaluation paper and electrostatic offset of the solid sections of the printed evaluation images was evaluated based on cycles of the fixing roller. The following evaluation standard was used.

Poor: Obvious electrostatic offset and poor image quality in at least one evaluation image Good: Good image quality in every evaluation image but slight electrostatic offset in at least one evaluation image Particularly Good: No electrostatic offset in any evaluation image and particularly good image quality in every evaluation image

[Evaluation Results]

Evaluation results for each of developers A-G are shown below.

TABLE 2

| | Developer | Image density | Toner scattering | Offset |
|---|---|---|---|---|
| Example 1 | Developer A | Particularly good | Particularly good | Particularly good |
| Example 2 | Developer B | Particularly good | Particularly good | Particularly good |
| Example 3 | Developer C | Good | Particularly good | Good |
| Example 4 | Developer D | Particularly good | Good | Particularly good |

TABLE 2-continued

| | Developer | Image density | Toner scattering | Offset |
|---|---|---|---|---|
| Comparative Example 1 | Developer E | Poor | Poor | Poor |
| Comparative Example 2 | Developer F | Poor | Poor | Poor |
| Comparative Example 3 | Developer G | Poor | Good | Good |

Each of developers A, B, C, and D (two-component developers according to Examples 1-4) had features (1) to (3) described above. More specifically, toner particles of each of the two-component developers according to Examples 1-4 included toner cores and shell layers disposed over the surface of the toner cores. Also, as shown in Table 1, the toner had a charge decay constant of at least 0.020 and no greater than 0.050 as measured with the toner particles in a state in which external additive was not adhered thereto (external additive-free state). Furthermore, the carrier had a volume resistivity of at least $1.0\times10^{12}$ Ω·cm. As shown in Table 2, the two-component developers according to Examples 1-4 each achieved good evaluation results in terms of image density, toner scattering, and electrostatic offset.

Evaluation apparatuses used to evaluate image density, toner scattering, and electrostatic offset for developers A and B (i.e., image forming apparatuses according to Examples 1 and 2) had feature (4). More specifically, in electrostatic latent image development, the image forming apparatuses according to Examples 1 and 2 each used a plurality of two-component developers (yellow, cyan, magenta, and black two-component developers), differing from one another in terms of toner charge decay constant (refer to Table 1), in order to develop electrostatic latent images formed on a plurality of electrostatic latent image bearing members. Also, the image forming apparatuses according to Examples 1 and 2 each performed primary transfer of toner images in descending order of toner charge decay constant (i.e., toners in the first, second, third, and fourth developing devices were used in the stated order for primary transfer). The image forming apparatuses according to Examples 1 and 2 each achieved particularly good evaluation results in terms of image density, toner scattering, and electrostatic offset.

What is claimed is:

1. An image formation method comprising:

developing electrostatic latent images, formed in one-to-one correspondence on a plurality of electrostatic latent image bearing members, to form toner images on the electrostatic latent image bearing members, each of the electrostatic latent images being developed using a two-component developer;

performing primary transfer to transfer the toner images formed on the electrostatic latent image bearing members to an intermediate transfer member, in order, such that the toner images are superposed on one another on the intermediate transfer member; and performing secondary transfer to collectively transfer the toner images to a transfer target from the intermediate transfer member, wherein in the developing of the electrostatic latent images formed in one-to-one correspondence on the electrostatic latent image bearing members, a plurality of different types of the two-component developer, differing from one another in terms of toner charge decay constant, are used, the primary transfer of the toner images is performed in descending order of toner charge decay constant, each of the plurality of different types of the two-component developer comprises:

a toner including a plurality of toner particles; and a carrier including a plurality of carrier particles, each of the toner particles includes a toner core and a shell layer disposed over a surface of the toner core, the toner has a charge decay constant of at least 0.020 and no greater than 0.050 as measured with the toner particles in an external additive-free state, and the carrier has a volume resistivity of at least $1.0\times10^{12}$ Ω·cm.

2. The image formation method according to claim 1, wherein in each of the plurality of different types of the two-component developer, the volume resistivity of the carrier is no greater than $1.0\times10^{15}$ Ω·cm.

3. The image formation method according to claim 1, wherein in each of the plurality of different types of the two-component developer, each of the carrier particles includes a carrier core and a coating layer disposed over the carrier core, and the carrier cores contain a ferrite and the coating layers are substantially composed of a fluorine-containing resin.

4. The image formation method according to claim 1, wherein in each of the plurality of different types of the two-component developer, the shell layers are substantially composed of a resin that results from polycondensation of an aldehyde with a compound having an amino group.

* * * * *